US006508235B2

(12) United States Patent
Fabre

(10) Patent No.: US 6,508,235 B2
(45) Date of Patent: Jan. 21, 2003

(54) VACUUM DETECTION COMPONENT

(75) Inventor: Laurent Fabre, Portet sur Garonne (FR)

(73) Assignee: Siemens Canada Limited (CA)

( * ) Notice: Subject to any disclaimer, the term of this patent is extended or adjusted under 35 U.S.C. 154(b) by 0 days.

(21) Appl. No.: 09/789,420

(22) Filed: Feb. 21, 2001

(65) Prior Publication Data

US 2001/0032625 A1 Oct. 25, 2001

Related U.S. Application Data

(60) Provisional application No. 60/184,193, filed on Feb. 22, 2000.

(51) Int. Cl.[7] ..... F02M 33/02

(52) U.S. Cl. ..... 123/520; 123/519

(58) Field of Search ..... 123/520, 198 D, 123/519, 518, 516; 73/119 A, 49.7

(56) References Cited

U.S. PATENT DOCUMENTS

| | | | | |
|---|---|---|---|---|
| 4,995,369 A | * | 2/1991 | Cook | 123/520 |
| 5,143,035 A | | 9/1992 | Kayanuma | 123/198 |
| 5,158,054 A | * | 10/1992 | Otsuka | 123/198 D |
| 5,263,462 A | | 11/1993 | Reddy | 123/520 |
| 5,295,472 A | | 3/1994 | Otsuka et al. | 123/520 |
| 5,333,589 A | * | 8/1994 | Otsuka | 123/520 |
| 5,398,661 A | | 3/1995 | Denz et al. | 123/520 |
| 5,451,927 A | * | 9/1995 | Thompson | 340/457 |
| 5,462,034 A | * | 10/1995 | Kadota | 123/520 |
| 5,490,414 A | | 2/1996 | Durschmidt et al. | 73/49.2 |
| 5,699,775 A | * | 12/1997 | Azuma | 123/520 |
| 5,744,701 A | | 4/1998 | Peterson et al. | 73/49.2 |
| 5,750,888 A | | 5/1998 | Matsumoto et al. | 73/118.1 |

FOREIGN PATENT DOCUMENTS

| | | |
|---|---|---|
| EP | 0 598 176 | 3/1994 |
| EP | 0 611 674 | 8/1994 |
| EP | 0 952 332 | 10/1999 |
| FR | 2 732 072 | 9/1996 |
| WO | WO 99/18419 | 4/1999 |
| WO | WO 99/37905 | 7/1999 |

OTHER PUBLICATIONS

International Search Report for Application No. PCT/CA01/00225; Jun. 11, 2001.

International Search Report for Application No. PCT/CA01/000224, Jun. 11, 2001.

(List continued on next page.)

*Primary Examiner*—Willis R. Wolfe
*Assistant Examiner*—Mahmoud Gimie

(57) ABSTRACT

A method of leak detection in a closed vapor handling system of an automotive vehicle, implemented by a system, the method including providing a vacuum detection component having a microcontroller operatively coupled to actuators and sensors, receiving at least one sensor signal from the sensors to the vacuum detection component, processing the at least one sensor signal in the microcontroller, sending output to an engine management system based on the at least one processed sensor signal, processing the output in the engine management system operatively coupled to a control valve, transmitting input from the engine management system to the vacuum detection component based on the processed output, and sending actuator signals from the microcontroller to the actuators. The system including a vacuum detection component having a microcontroller operatively coupled to actuators and sensors, the microcontroller sending and receiving, respectively, signals therefrom and a processor communicating with the microcontroller, the microcontroller processing the signals and sending output based on the processed signals to the processor, the processor processing the output and transmitting input to the microcontroller based on the processed output.

41 Claims, 4 Drawing Sheets

U.S. PATENT DOCUMENTS

| | | | | |
|---|---|---|---|---|
| 5,957,115 | A | 9/1999 | Busato et al. | 123/520 |
| 5,967,124 | A | 10/1999 | Cook et al. | 123/520 |
| 5,988,206 | A | 11/1999 | Bare et al. | 137/354 |
| 6,073,487 | A | 6/2000 | Dawson | 73/118.1 |
| 6,089,081 | A | 7/2000 | Cook et al. | 73/118.1 |
| 6,158,270 | A | 12/2000 | Garman et al. | 73/40.7 |
| 6,164,123 | A | 12/2000 | Corkill | 73/49.7 |
| 6,182,642 | B1 | 2/2001 | Ohkuma | 123/520 |

* cited by examiner

VACUUM DETECTION COMPONENT

REFERENCE TO RELATED APPLICATION

This application expressly claims the benefit of the earlier filing date and right of priority from the following patent application: U.S. Provisional Application Serial No. 60/184,193, filed on Feb. 22, 2000 in the name of Laurent Fabre and Pierre Calvairac and entitled "Vacuum Detection." The entirety of that earlier filed co-pending provisional patent application is expressly incorporated herein by reference.

FIELD OF INVENTION

This invention relates to leak detection methods and systems, and more particularly, to automotive fuel leak detection using a pressure switch and a temperature differential.

BACKGROUND OF INVENTION

In a vapor handling system for a vehicle, fuel vapor that escapes from a fuel tank is stored in a canister. If there is a leak in the fuel tank, the canister, or any other component of the vapor handling system, fuel vapor could exit through the leak to escape into the atmosphere.

Vapor leakage may be detected through evaporative monitoring. Small leaks and large leaks may be detected by using a temperature and pressure in the vapor handling system and a processor. In detecting these leaks, it may be desirable to have low electrical consumption, a low cost to performance ratio, easy implementation and installation, and components independent of the processor.

SUMMARY OF THE INVENTION

The present invention provides a method of leak detection in a closed vapor handling system of an automotive vehicle. This method includes providing a vacuum detection component having a microcontroller operatively coupled to actuators and sensors, receiving at least one sensor signal from the sensors to the vacuum detection component, processing the at least one sensor signal in the microcontroller, sending output to an engine management system based on the at least one processed sensor signal, processing the output in the engine management system operatively coupled to a control valve, transmitting input from the engine management system to the vacuum detection component based on the processed output, and sending actuator signals from the microcontroller to the actuators.

The present invention also provides another method of leak detection in a closed vapor handling system of an automotive vehicle. This method includes providing a vacuum detection component having a microcontroller operatively coupled to a pressure switch, a temperature sensor, and a shut off valve, the vacuum detection component communicating with a power source and providing a communication interface, receiving a pressure signal and a temperature signal from the pressure switch and temperature sensor, respectively, by the microcontroller, processing the pressure signal and the temperature signal in the microcontroller, determining a diagnostic result in the microcontroller based on the signals, sending the diagnostic result to an engine management system, processing the diagnostic result in the engine management system, transmitting a diagnosis request, a reset diagnosis, purge status, and engine status from the engine management system to the microcontroller, and sending an operation request from the engine management system to the shut off valve. The diagnostic result includes whether a leak condition exits, whether a tank cap is missing and whether a component diagnoses fails. The engine management system is operatively coupled to a control valve, and the engine management system provides a communication interface and detects an onboard diagnostic error.

The present invention also provides an automotive evaporative leak detection system. This system includes a vacuum detection component having a microcontroller operatively coupled to actuators and sensors, which the microcontroller sends and receives, respectively, signals therefrom and a processor communicating with the microcontroller. The microcontroller processes the signals and sends output based on the processed signals to the processor. The processor processes the output and transmits input to the microcontroller based on the processed output.

The present invention further provides another automotive evaporative leak detection system. This system includes a vacuum detection component having a microcontroller operatively coupled to a pressure switch, a temperature sensor, and a shut off valve, which the microcontroller sends and receives, respectively, signals therefrom, a control valve located between the canister and the engine, and a processor communicating with the microcontroller. The vacuum detection unit is located on a conduit between an atmosphere and a canister, the canister communicates with an engine and the atmosphere, and the engine communicates with a fuel tank. The microcontroller processes the signals, determines a diagnostic result based on the signals, provides a communication interface, and sends the diagnostic result to the processor. The processor is operatively coupled to the control valve and provides a communication interface, detects an onboard diagnostic error, requests a diagnosis, deletes a diagnosis result, determines whether the engine is off, requests operation of the shut off valve, and provides purge status.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain the features of the invention.

DETAILED DESCRIPTION OF THE PREFERRED EMBODIMENTS

Reference will now be made in detail to the preferred embodiments of the present invention, examples of which are illustrated in the accompanying drawings. It is to be understood that the Figures and descriptions of the present invention included herein illustrate and describe elements that are of particular relevance to the present invention, while eliminating, for purposes of clarity, other elements found in typical automotive vehicles and vapor handling systems.

Figure 1:
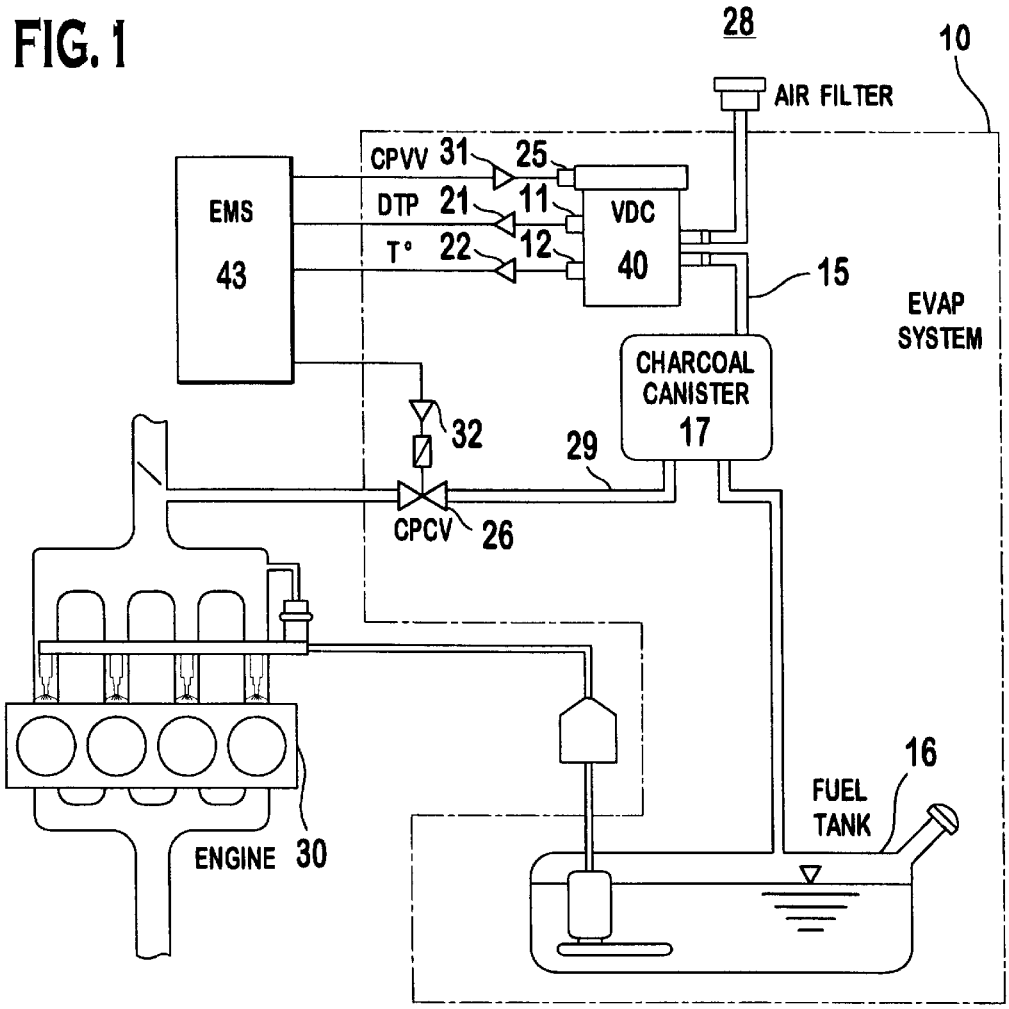
FIG. 1 is a schematic view of a preferred embodiment of the system of the present invention.

As shown in FIG. 1, an evaporative leak detection system 10 in an automotive vehicle includes a vacuum detection component 40 located on a conduit 15 between an atmosphere 28 and a canister 17. The vacuum detection component 40 has sensors, such as a pressure sensing element 11 that provides pressure signals and a temperature sensing element 12 that provides temperature signals, and actuators, such as a shut off valve 25 that receives operation signals 31. Preferably, the pressure sensing element 11 is in fluid communication with fuel tank vapor and the temperature sensing element 12 is in thermal contact with the fluid tank vapor. The pressure sensing element 11 may be a differential pressure sensor that provides a pressure with the system 10 in comparison to the atmosphere 28. The pressure sensing element 11 may also be a switch that moves at a given relative vacuum or a pair of switches that move at different relative vacuums. The temperature sensing element 12 may be a temperature sensor, a transducer, or resistor/capacitor assembly, that supplies differential temperature, or a model based on induction air temperature and engine coolant temperature with a statistical treatment. The shut off valve 25 is, preferably, a canister purge vent valve. The canister 17 communicates with an engine 30 and the atmosphere 28, and the engine 30 communicates with a fuel tank 16.

In a preferred embodiment, the vacuum detection component 40 performs large and small leak detection based on the pressure signal and/or temperature signal, detects whether a tank cap is missing, performs a component diagnosis that may include the actuators and sensors, and provides a communication interface for customed communication. In an alternative embodiment, the vacuum detection component 40 performs small leak detection and provides the communication interface.

A processor, or engine management system, 43 is operatively coupled to, or in communication with, the vacuum detection component 40 and a control valve 26. In the preferred embodiment, the processor 43 provides a communication interface for customed communication and manages on board diagnostic errors. In an alternative embodiment, the processor 43 performs large leak detection by receiving and processing pressure and temperature signals 21 and 22, respectively, from the pressure switch 11 and temperature sensing element 12, respectively, and sending signals 31 and 32, respectively, to open and close the valves 25 and 26, respectively. The processor 43 also detects whether the tank cap is missing and performs the component diagnosis. The control valve 26, or preferably, a canister purge control valve, is located on a conduit 29 between the canister 17 and the engine 30. Closing the control valve 26 seals the system 10 from the engine 30.

Figure 2:
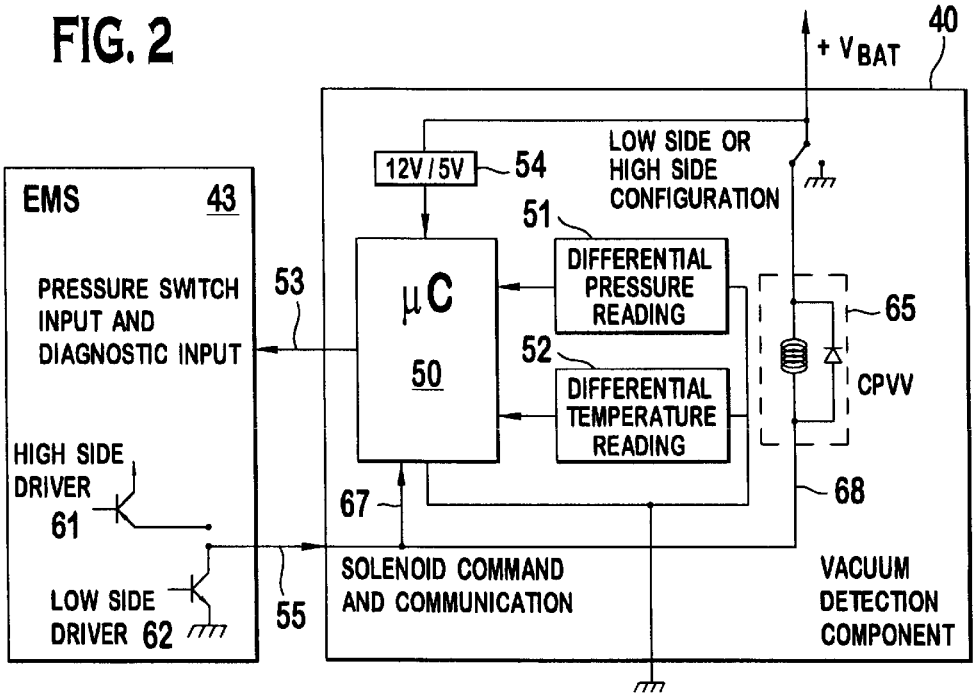
FIG. 2 is a schematic view of a first embodiment of the vacuum detection component of the present invention.

In a first embodiment of the vacuum detection component 40, as shown in FIG. 2, the vacuum detection component 40 also has a microcontroller 50. The microcontroller 50 is operatively coupled to a pressure switch 51, a temperature sensor 52, and a shut off valve 65. The microcontroller 50 receives and processes the sensor signals from the pressure switch 51 and the temperature sensor 52. The sensor signals may include a differential pressure and a differential temperature. The processing may include obtaining a start temperature and a start pressure, providing an evaluation temperature, calculating a temperature differential between the start temperature and the evaluation temperature, incrementing a time counter if the temperature differential is greater than a temperature control value, computing a pressure differential between the start pressure and an evaluation pressure, and comparing the time counter to a time control value if the pressure differential is not greater than a pressure control value. The processing is described in detail and may also include other methods and algorithms disclosed in a co-pending patent application filed on even date, Application Serial No.: 09/790,168, entitled "LEAK DETECTION IN A CLOSED VAPOR HANDLING SYSTEM USING PRESSURE, TEMPERATURE AND TIME," which is incorporated herein by reference in its entire. The microcontroller 50 may include the necessary memory or clock or be coupled to suitable circuits that implement the communication and a power source 54.

The microcontroller 50 sends output 53 to the processor 43 based on the processed sensor signals. In the first embodiment, the output 53 includes pressure switch input and a diagnostic result. The processor 43 receives the output 53 and processes the output 53. The processor 43 transmits input 55 to the vacuum detection component 40 based on the processed output by sending communication signals 67 to the microcontroller 50 and actuator signals 68 to the shut off valve 65.

The vacuum detection component 40 may accommodate any type of processor driving circuitry. In FIG. 2, the vacuum detection component 40 may accommodate a processor 43 having either a high side driver 61 or a low side driver 62. If the processor 43 has a high side driver 61, the emitter of a PNP-type transistor internal to the processor 43 may be electrically connected to a solenoid command and communication line 55 such that when the base of the PNP transistor is driven by the processor 43, the emitter applies a driving voltage to the shut off valve actuator 65. If the processor 43 has a low side driver 62, the collector of a NPN-type transistor may be electrically connected to the solenoid command and communication line 55 such that when the base of the NPN transistor is driven to ground the processor 43, the collector applies a driving voltage to the shut off valve actuator 65.

Figure 3:
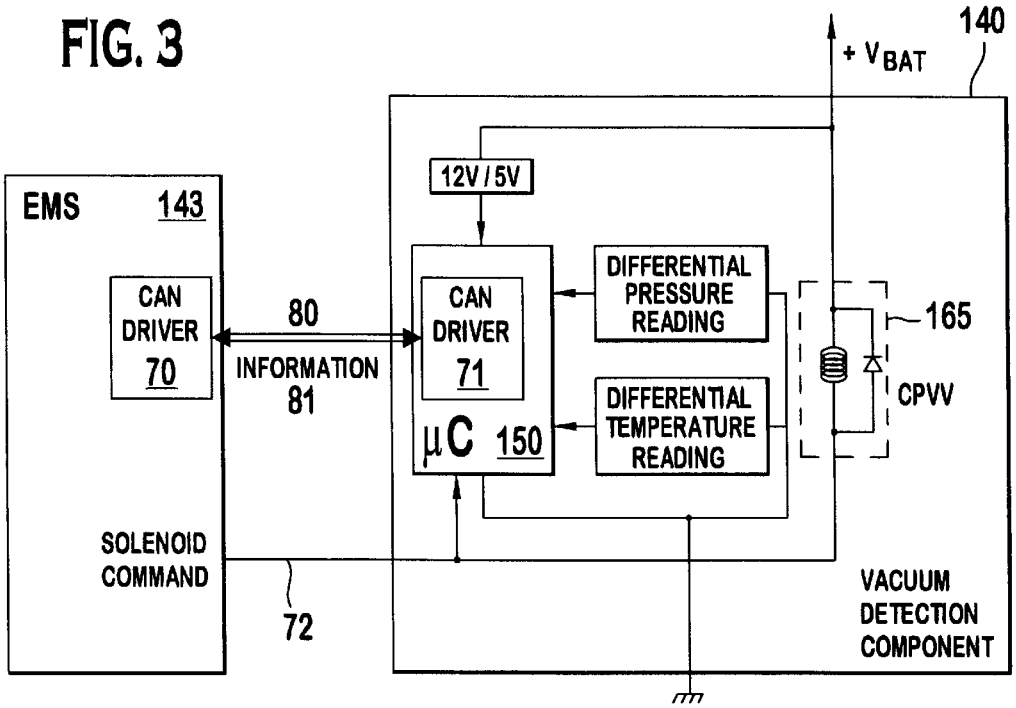
FIG. 3 is a schematic view of a second embodiment of the vacuum detection component of the present invention.

In the second embodiment of the vacuum detection component 140, as shown in FIG. 3, the communications between the component 140 and the processor 143 may also include CAN, or Controller Area Network, communication drivers 70 and 71. The CAN drivers exchange data and signals. The CAN driver 71 maybe included in the microcontroller 150 or added to the PCB as a discrete component. Using CAN drivers for the communication between the vacuum detection component 140 and the processor 143 allows for a powerful system of communication that permits optional information to be communicated, meeting of automotive standards and no need of a specification in the processor 143 dedicated to the communication. It should be understood that other drivers known in the art, such as K and L and LIN drivers, may also be used.

The microcontroller 150 may send information 80, including a diagnosis result, to the processor 143, while the processor 143 may send information 81, including a diagnosis request, a diagnosis clear, which resets or deletes the diagnostic result, and engine status to the microcontroller 150 and a solenoid command to the microcontroller 150 and the shut off valve 165. The engine status includes whether the engine is off. The information 80 may also include a control valve operation request to open or close the control valve and an on board diagnostic sequencer request. The information 81 may also include a shut off valve operation request to open or close the shut off valve 165, canister purge status, and, optionally, on board diagnostic sequencer authorization.

Figure 4:
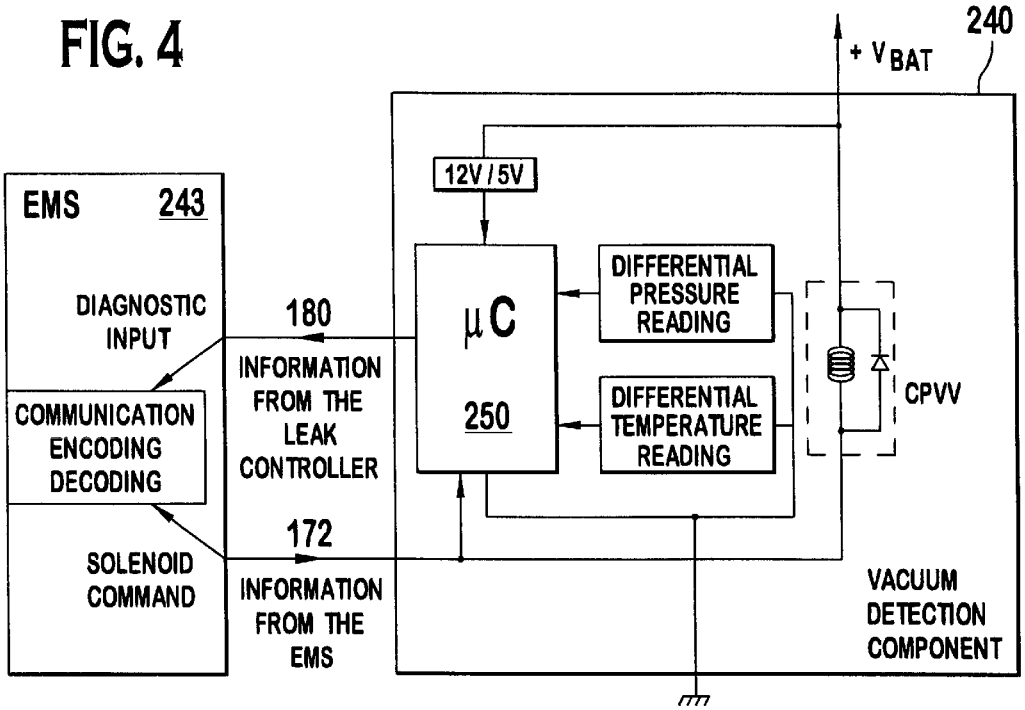
FIG. 4 is a schematic view of a third embodiment of the vacuum detection component of the present invention.

In the third embodiment, as shown in FIG. 4, the communications between the component 240 and the processor 243 include a customed communication based on existing wires, or lines, between the processor 243 and vacuum detection component 240. Information 172 from the processor 243 is added to a line for the shut off valve driver. The information 172 may be communicated by a serial pulse signal at a frequency that prevents a shut off valve reaction. The information 180 from the microcontroller 250 may be communicated by coding messages as diagnoses or requests. Using existing wiring for the communication between the vacuum detection component 240 and the processor 243 allows for low costs.

Figure 5:
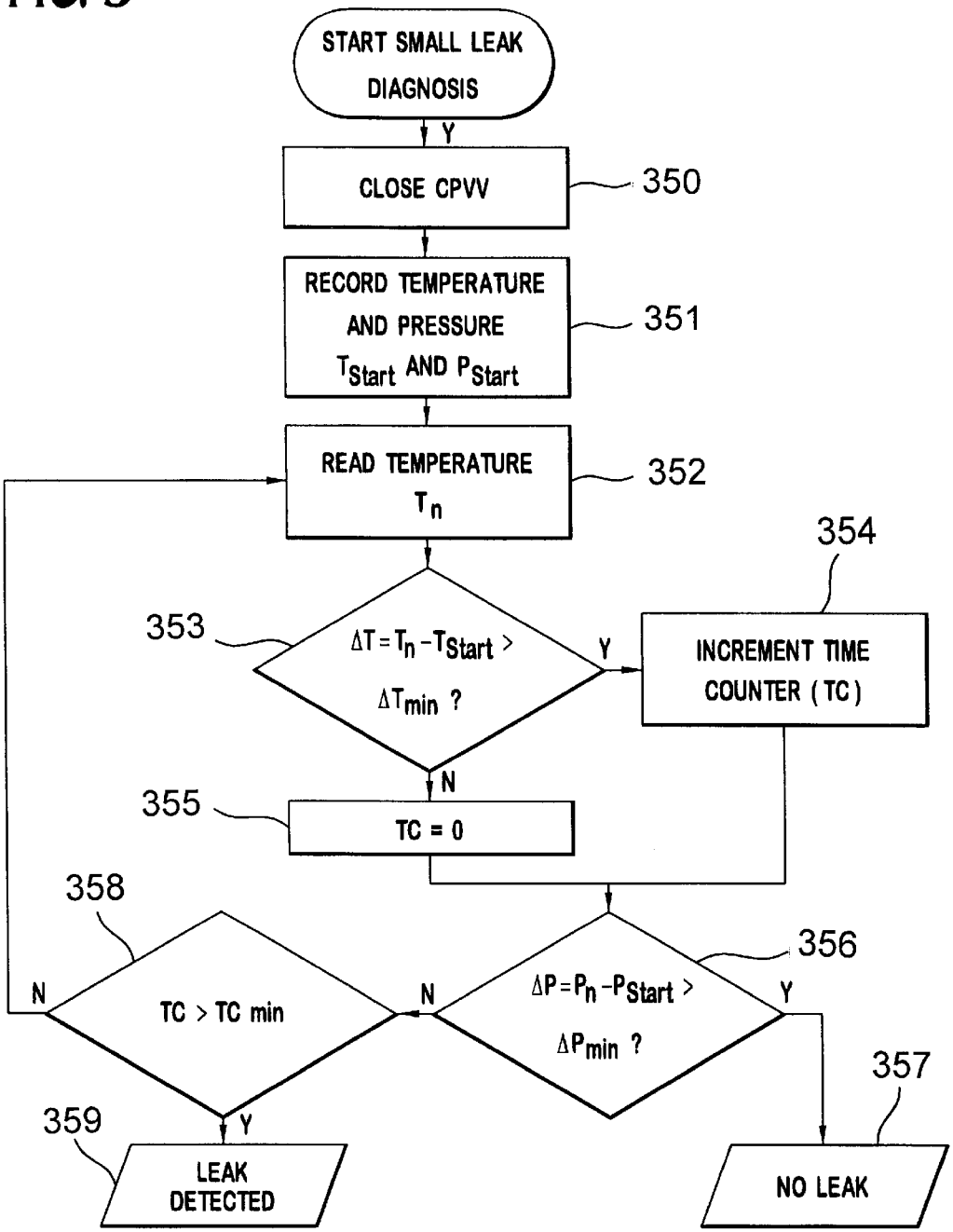
FIG. 5 is a block diagram of the preferred embodiment of a method of leak detection according to the present invention.

As shown in FIG. 5, when the engine is off, in step 350, preferably, the shut off valve 25 is closed. Preferably, the processor 43,143,143 sends the signal 31 to close the shut off valve 25. The system 10 will be sealed from the engine 30 and the atmosphere 28 and an ambient temperature decrease will lead to a temperature decrease in the fuel tank 16. The microcontroller 50,150,250 receives a start temperature and start pressure from the temperature sensor 52 and pressure switch 51, respectively, in step 351. To measure the decrease of temperature, in step 352, the temperature sensor 52 also provides an evaluation temperature to the microcontroller 50,150,250. This evaluation temperature is read after a specified period of time. It should be understood that the specific period of time is determined based on the particular system's application, such that the specified period of time is measured between the start temperature reading and the evaluation temperature reading. The microcontroller 50,150, 250 calculates, in step 353, the temperature differential, which is the difference between the start temperature mid the evaluation temperature, and compares the temperature differential to a temperature control value. It should be understood that temperature control value is determined based on the outside, or ambient, temperature, the fuel tank temperature when the engine is running and the expected decrease in temperature over time when the engine is shut off and there is no leak.

If the temperature differential is greater than the temperature control value, a time counter is incremented in step 354. On the other hand, if the temperature differential is not greater then the temperature control value, the time counter is set to zero in step 355. It should be understood that the temperature differential used in the comparison is an absolute value because the temperature should actually decrease and the temperature differential will be a negative value. Alternatively, if the temperature differential is not an absolute value, then the method will proceed to step 354 if the temperature differential is less than the temperature control value and will proceed to step 355 if the temperature differential is not less than the temperature control, value.

Whether the temperature differential, using the absolute value, is greater than or not greater than the temperature control value, in step 356, the microcontroller 50,150,250 computes a pressure differential, which is also an absolute value, between the start pressure and an evaluation pressure, and compares the pressure differential to a pressure control value. It should be understood that the pressure control value is determined based on the expected temperature decrease in a system with no leak and the $(\Delta P)V = nR(\Delta T)$ relationship. If the pressure differential is greater than the pressure control value, then a no leak condition is determined in step 357 and the leak detection diagnosis will end. Since the volume of the fuel tank 16 is constant, the gas mass within the fuel tank 16 is constant, and the temperature is decreasing, if the pressure also is decreasing there is no leak.

On the other hand, if the pressure differential is not greater than the pressure control value, then the microcontroller 50,150,250 compares the time counter to a time control value in step 358. If the time counter is not greater than the time control value, another evaluation temperature will be read in step 352. However, if the time counter is greater than the time control value, then the system 10 determines a leak condition in step 359. Since the temperature is decreasing axed the volume of the fuel tank 16 is constant, the gas mass within the fuel tank 16 is increasing and there will be no change in pressure after a short transient of time.

While the invention has been described in detail and with reference to specific features, it will be apparent to one skilled in the art that various changes and modifications can be made therein without departing from the spirit and scope of the invention. It is intended that the present invention cover the modifications and variations of this invention provided they come within the scope of the appended claims and their equivalents.

What I claim is:

1. A method of leak detection in a closed vapor handling system of an automotive vehicle having an engine that is shut-off, the method comprising:

providing a vacuum detection component having a microcontroller operatively coupled to actuators and sensors;

receiving when the engine is shut-off at least one sensor signal from the sensors by the vacuum detection component;

processing the at least one sensor signal in the microcontroller;

sending output to an engine management system based on the at least one processed sensor signal;

processing the output in the engine management system operatively coupled to a control valve;

transmitting input from the engine management system to the microcontroller based on the processed output; and sending actuator signals from the microcontroller to the actuators.

2. The method of claim 1 wherein the providing comprises:

using a shut off valve as an actuator; and employing a pressure sensing element and a temperature sensing element as sensors.

3. The method of claim 1 wherein the providing comprises:

employing at least one of a differential pressure sensor, a pressure switch that moves at a relative given vacuum and a pair of switches that move at different relative vacuums as sensors.

4. The method of claim 1 wherein the providing comprises:

employing at least one of a temperature sensor, a transducer that provides differential temperature and a model based on induction air temperature and engine coolant temperature with a statistical treatment as sensors.

5. The method of claim 1 wherein the providing comprises:

using a canister purge vent valve as an actuator.

6. The method of claim 1 wherein the receiving comprises:

obtaining a differential pressure and a differential temperature.

7. The method of claim 1 wherein the processing the at least one sensor signal comprises:

determining a small leak condition based on the at least one sensor signal; and providing a communication interface.

8. The method of claim 7 further comprising:

determining a large leak condition based on the at least one sensor signal;

detecting whether a tank cap is missing; and performing a component diagnosis.

9. A method of leak detection in a closed vapor handling system of an automotive vehicle comprising:

providing a vacuum detection component having a microcontroller operatively coupled to actuators and sensors;

receiving at least one sensor signal from the sensors by the vacuum detection component;

processing the at least one sensor signal in the microcontroller, the processing the at least one sensor signal including:

obtaining a start temperature and a start pressure;

providing an evaluation temperature;

calculating a temperature differential between the start temperature and the evaluation temperature;

incrementing a time counter if the temperature differential is greater than a temperature control value;

computing a pressure differential between the start pressure and an evaluation pressure; and comparing the time counter to a time control value if the pressure differential is not greater than a pressure control value;

sending output to an engine management system based on the at least one processed sensor signal;

processing the output in the engine management system operatively coupled to a control valve;

transmitting input from the engine management system to the microcontroller based on the processed output; and sending actuator signals from the microcontroller to the actuators.

10. The method of claim 1 wherein the sending comprises:

providing a diagnosis result.

11. The method of claim 10 further comprising:

requesting operation of the control valve, wherein the engine management system communicates with the control valve when an operation request is received; and providing a request to an onboard diagnostic sequencer.

12. The method of claim 1 wherein the processing the output comprises:

providing a communication interface; and detecting an onboard diagnostic error.

13. The method of claim 12 further comprising:

determining a large leak condition based on the output;

detecting whether a tank cap is missing; and performing a component diagnosis.

14. The method of claim 1 wherein the transmitting comprises:

requesting a diagnosis;

deleting a diagnostic result; and determining whether the engine is off.

15. The method of claim 14 wherein the transmitting comprises:

requesting operation of the shut off valve;

providing purge status; and authorizing an onboard diagnostic sequencer.

16. The method of claim 1 further comprising:

providing a power source to the vacuum detection component.

17. The method of claim 1 further comprising:

providing at least one of a low side driver and a high side driver.

18. The method of claim 1 further comprising:

providing a shut off valve driver that communicates by a serial pulse signal at a frequency that prevents a shut off valve reaction.

19. The method of claim 1 further comprising:

providing a CAN driver to receive output and transmit input.

20. The method of claim 9, wherein the providing a vacuum detection component comprises:

using as an actuator at least one of a shut off valve and a canister purge vent valve; and employing as a sensor at least one of a differential pressure sensor, a pressure switch that moves at a relative given vacuum, a pair of switches that move at different relative vacuums, a temperature sensor, a transducer that provides differential temperature, and a model based on induction air temperature and engine coolant temperature with a statistical treatment.

21. The method of claim 9, further comprising:

shutting-off an engine coupled to the engine management system.

22. A method of leak detection in a closed vapor handling system of an automotive vehicle having an engine that is shut-off, the method comprising:

providing a vacuum detection component having a microcontroller operatively coupled to a pressure switch, a temperature sensor, and a shut off valve, the vacuum detection component communicating with a power source and providing a communication interface;

receiving when the engine is shut-off a pressure signal and a temperature signal from the pressure switch and temperature sensor, respectively, by the microcontroller;

processing the pressure signal and the temperature signal in the microcontroller;

determining a diagnostic result in the microcontroller based on the signals, the diagnostic result including whether a leak condition exits, whether a tank cap is missing and whether a component diagnoses passes;

sending the diagnostic result to an engine management system;

processing the diagnostic result in the engine management system, the engine management system operatively coupled to a control valve, the engine management system providing a communication interface and detecting an onboard diagnostic error;

transmitting a diagnosis request, a reset diagnosis, purge status, and engine status from the engine management system to the microcontroller; and sending an operation request from the engine management system to the shut off valve.

23. An automotive evaporative leak detection system operating when an engine is shut-off, the system comprising:

a vacuum detection component having a microcontroller operatively coupled to a pressure switch, a temperature sensor, and a shut off valve, the microcontroller sending and receiving, respectively, signals therefrom when the engine is shut-off, the vacuum detection unit located on a conduit between an atmosphere and a canister, the canister communicating with the engine and an atmosphere, the engine communicating with a fuel tank;

a control valve located between the canister and the engine; and a processor communicating with the microcontroller, the processor operatively coupled to the control valve;

wherein the microcontroller processes the signals, determines a diagnostic result based on the signals, provides a communication interface, and sends the diagnostic result to the processor, the processor provides a communication interface, detects an onboard diagnostic error, requests a diagnosis, deletes a diagnosis result, determines whether the engine is off, requests operation of the shut off valve, and provides purge status.

24. An automotive evaporative leak detection system operating when an engine is shut-off, the system comprising:

a vacuum detection component having a microcontroller operatively coupled to actuators and sensors, the microcontroller sending and receiving, respectively, signals therefrom when the engine is shut-on; and a processor communicating with the microcontroller, the microcontroller processing the signals and sending output based on the processed signals to the processor, the processor processing the output and transmitting input to the microcontroller based on the processed output.

25. The system of claim 24 wherein the sensors comprise a pressure sensing element in fluid communication with fuel tank vapor and a temperature sensing element in thermal contact with fuel tank vapor.

26. The system of claim 24 wherein the sensors comprise at least one of a differential pressure sensor, a pressure switch that moves at a given relative vacuum and a pair of pressure switches that move at different relative vacuums.

27. The system of claim 24 wherein the sensors comprise a temperature sensor, a transducer that provides differential temperature and a model based on induction air temperature and engine coolant temperature with a statistical treatment.

28. The system of claim 24 wherein the microcontroller calculates a temperature differential between a start temperature and an evaluation temperature, increments a time counter, computes a pressure differential between a start pressure and an evaluation pressure, and compares a time counter to the time control value.

29. The system of claim 24 wherein the processor is operatively coupled to a control valve.

30. The system of claim 24 wherein the actuators comprises canister purge vent valve.

31. The system of claim 24 wherein the actuators comprise a shut off valve.

32. The system of claim 24 wherein the signals comprise a differential pressure and a differential temperature.

33. The system of claim 24 wherein the sensors comprise a temperature sensing element and a pressure sensing element and the actuators comprise a shut off valve, further comprising:

a fuel tank communicating with an engine;

a canister communicating with the fuel tank, the engine and an atmosphere; and a control valve operatively coupled to the processor and located between the canister and the engine, wherein the vacuum detection unit is located on a conduit between the canister and the atmosphere.

34. The system of claim 24 wherein the output comprises a diagnostic result.

35. The system of claim 24 wherein the output comprises a control valve operation request and an onboard diagnostic sequencer request.

36. The system of claim 24 wherein the processor provides a communication interface, detects an onboard diagnostic error, requests a diagnosis, deletes a diagnostic result, determines whether the engine is off, requests operation of the shut off valve, provides purge status, and authorizes an onboard diagnostic sequencer.

37. The system of claim 24 wherein the processor determines a large leak condition based on the output, detects whether a tank cap is missing, performs a component diagnosis, provides a communication interface, detects an onboard diagnostic error, requests a diagnosis, deletes a diagnostic result, and determines whether the engine is off.

38. The system of claim 24 wherein the processor and the microcontroller communicate by at least one of a low side driver and a high side driver.

39. The system of claim 24 wherein the processor and the microcontroller communicate by a CAN driver.

40. The system of claim 24 wherein the processor and the microcontroller communicate by a shut off valve driver that sends and receives serial pulse signals at a frequency that prevents a shut off valve reaction.

41. The system of claim 24 wherein the vacuum detection component communicates with a power source.

* * * * *